US006070969A

United States Patent [19]

Buonanno

[11] Patent Number: 6,070,969

[45] Date of Patent: Jun. 6, 2000

[54] THERMAL INKJET PRINTHEAD HAVING A PREFERRED NUCLEATION SITE

[75] Inventor: Mark A. Buonanno, Albany, Oreg.

[73] Assignee: Hewlett-Packard Company, Palo Alto, Calif.

[21] Appl. No.: 08/218,951

[22] Filed: Mar. 23, 1994

[51] Int. Cl.[7] ..... B41J 2/05

[52] U.S. Cl. ..... 347/64; 347/62

[58] Field of Search ..... 347/64, 65, 63, 347/62, 61

[56] References Cited

U.S. PATENT DOCUMENTS

| | | | |
|---|---|---|---|
| 4,336,548 | 6/1982 | Matsumoto | 347/64 |
| 4,339,762 | 7/1982 | Shirato | 347/62 |
| 4,513,298 | 4/1985 | Scheu | 347/64 |
| 4,514,741 | 4/1985 | Meyer | 347/62 |
| 4,535,343 | 8/1985 | Wright et al. | 347/64 |
| 4,792,818 | 12/1988 | Eldridge et al. | 347/62 |
| 4,794,411 | 12/1988 | Taub et al. | 347/56 X |
| 4,809,428 | 3/1989 | Aden et al. | 347/63 X |
| 4,870,433 | 9/1989 | Campbell et al. | 347/62 |
| 4,926,197 | 5/1990 | Childers et al. | 347/63 |
| 4,935,752 | 6/1990 | Hawkins | 347/62 |
| 5,041,844 | 8/1991 | Deshpande | 347/65 |
| 5,142,308 | 8/1992 | Hassegawa et al. | 347/62 |
| 5,169,806 | 12/1992 | Hawkins et al. | 347/62 X |
| 5,206,659 | 4/1993 | Sakurai et al. | 347/62 |
| 5,293,182 | 3/1994 | Sekiya | 347/62 |

FOREIGN PATENT DOCUMENTS

| | | | |
|---|---|---|---|
| 0124312 | 4/1984 | European Pat. Off. | B41J 3/04 |
| 63-034144 | 2/1988 | Japan | B41J 3/04 |
| 2103150 | 4/1990 | Japan | B41J 2/05 |

OTHER PUBLICATIONS

Paul G. Shewmon, Transformations in Metals, McGraw–Hill Book Company 1969, pp. 156–163.

Ross R. Allen et al, Thermodynamics and Hydrodynamics of Thermal Ink Jets, Hewlett–Packard Journal, vol. 36, No. 5, May 1985, pp. 21–27.

*Primary Examiner*—Joseph Hartary
*Attorney, Agent, or Firm*—Raymond A. Jenski

[57] ABSTRACT

A preferred nucleation site is established in an ink firing chamber for a thermal inkjet printhead. The cavitation barrier layer of the resistance heater substrate is created with particular surface discontinuities and a temperature profile which favor heterogeneous bubble nucleation in a predetermined area. The predetermined area is located essentially along the axis of the ink droplet expulsion orifice.

22 Claims, 5 Drawing Sheets

THERMAL INKJET PRINTHEAD HAVING A PREFERRED NUCLEATION SITE

BACKGROUND OF THE INVENTION

This invention is generally related to printheads for thermal inkjet printers and more particularly related to a thermal inkjet printhead having a predetermined site for the nucleation of thermally induced ink bubbles.

Thermal inkjet printing has become one of the standard techniques of transferring computer generated images or text onto tangible media such as paper or transparency film. Generally, a number of small orifices are arranged in such a fashion in a substrate that the expulsion of one or more droplets of ink from a determined number of orifices relative to a particular position of the medium results in the production of a portion (a pixel) of a desired character or image. Controlled repositioning of the substrate or the medium and another expulsion of ink droplets continues the production of more pixels of the desired character or image.

Expulsion of the ink droplet in a conventional thermal inkjet printer is a result of rapid thermal heating of the ink to a temperature which exceeds the boiling point of the ink solvent and creates a gas phase bubble of ink. Each orifice is coupled to a small unique chamber filled with ink and having an individually addressable heating element in thermal contact with the ink. As the bubble nucleates and expands, it displaces a volume of ink which is forced out of the orifice and deposited on the medium. The bubble then collapses and the displaced volume of ink is replenished from a larger ink reservoir.

It is desirable that the bubble be controlled in several aspects of its brief existence, including its rate of expansion, its ultimate volume, and its shape. The rate of expansion is primarily a function of the rate of heat energy input, the thermal properties of the ink, and the ambient temperature and pressure. The bubble volume is primarily related to the period of time the heat energy is input to the ink and the size of the firing chamber and heating device. The shape of the bubble is related to the physical configuration of the heating element and the shape of the ink chamber.

At the commencement of the heat energy output from the heating element, bubble nucleation generally commences at locations of dissimilarities in the ink liquid or at defect sites on the surface of the heating element or other interface surfaces (heterogeneous nucleation). It is well known that heterogeneous nucleation of a bubble is favored to occur energetically at interfaces. Although it is possible to promote homogeneous nucleation, it is not possible to do so in the absence of heterogeneous nucleation occurring at the interface between the ink and the contact surface where heat transfer occurs. Additional discussion regarding ink bubble formation for thermal inkjet printheads may be found in "Thermodynamics and Hydrodynamics of Thermal Inkjets" by Allen et al., *Hewlett-Packard Journal*, Vol. 36, No. 5, May 1985, pp. 21–27. If the location of these nucleation sites is not optimized, bubble formation will occur randomly or at various uncontrolled sites within the ink firing chamber. Therefore, although one may wish to drive the process to homogeneous nucleation on the heating surface of the structure, it is necessary to understand the interplay and negative aspects of heterogeneous nucleation which occurs due to its reduced energy requirement at the high energy interface. Earlier attempts at controlling bubble generation have concentrated upon spacing bubble generation away from cavitation-sensitive structures by construction of other low temperature structures or by overlaying discrete heat occluding devices on the passivation surface protecting the resistive layer. Each of these attempts, however, lack an integral surface layer which provides a favorable and controlled location for heterogeneous nucleation while maintaining a ruggedness of structure to withstand mechanical, chemical, and thermal stress associated with thermal inkjet printing. It can be appreciated, then, that, an apparatus which could control the bubble heterogeneous nucleation site would advantageously form a consistently located and well defined and reproducible bubble and produce a higher quality printed character or image.

SUMMARY OF THE INVENTION

A thermal inkjet printhead utilizes a preferred heterogeneous nucleation site in an ink firing chamber. An electrically activated heating element is disposed in thermal communication with the ink firing chamber and a thermally insulating layer is disposed between the heating element and the ink firing chamber. Located on the surface of the thermally insulating layer, which is in contact with the ink, is at least one preferred heterogeneous nucleation site. An orifice plate forms a boundary of the ink firing chamber and includes at least one orifice from which ink from the ink firing chamber is expelled when the heating element is electrically activated.

DESCRIPTION OF A PREFERRED EMBODIMENT

Figure 1:
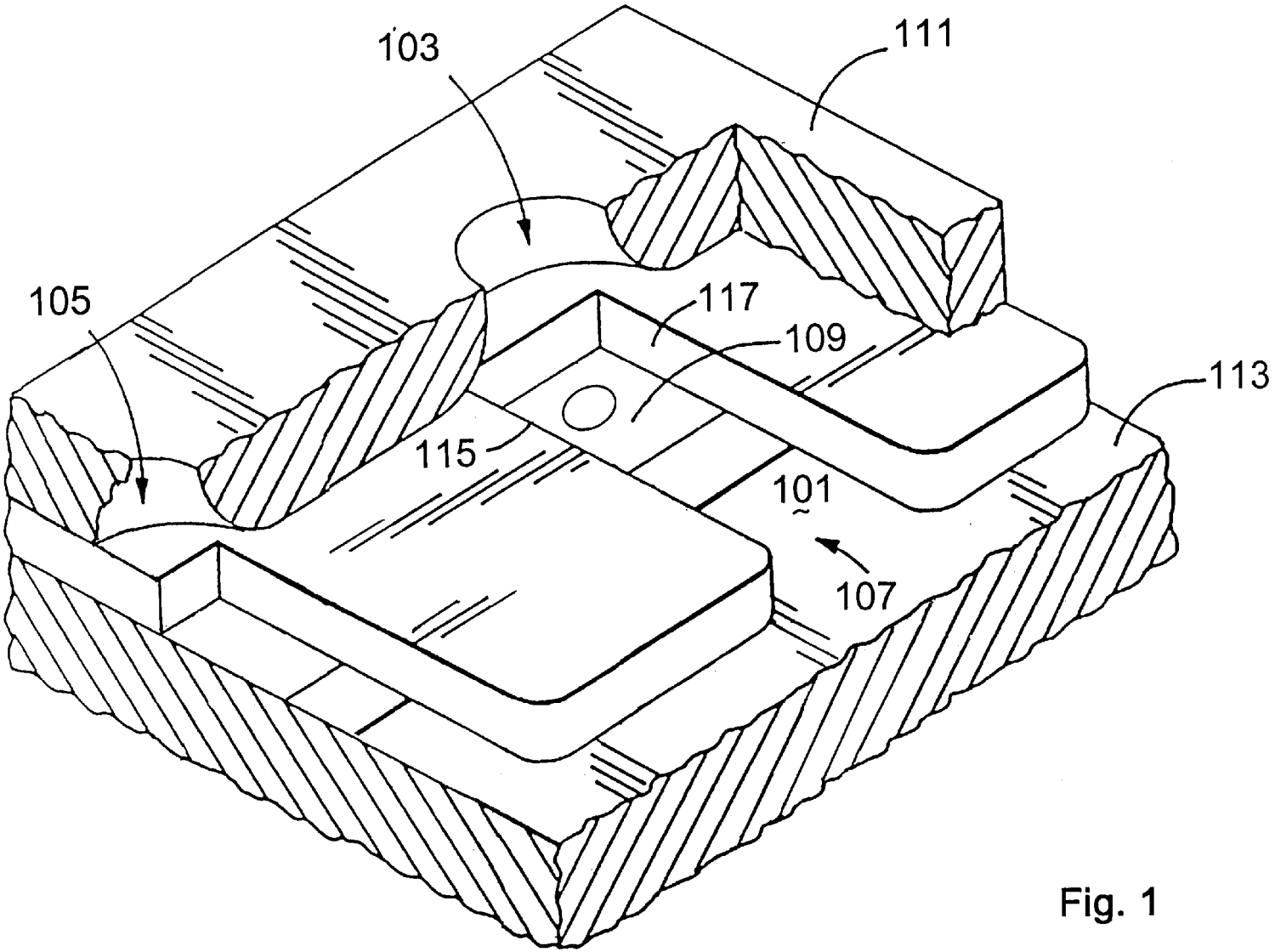
FIG. 1 is a sectioned isometric view of a thermal inkjet printhead which may employ the present invention.

The quality of the printed image from a thermal inkjet printer is improved with the incorporation of the present invention in the printhead of a printer. FIG. 1 is a view of a portion of a thermal inkjet printhead illustrating an ink firing chamber 101 and an orifice 103 associated with the ink firing chamber 101. Part of a second orifice 105 associated with another ink firing chamber is also shown. Many orifices are typically arranged in a predetermined pattern on the orifice plate so that the ink which is expelled from selected orifices creates a defined pattern of print on the medium. Generally, the medium is maintained in a position which is parallel to the external surface of the orifice plate. Ink is supplied to the firing chamber 101 via opening 107 to replenish ink which has been expelled from orifice 103 when ink has been vaporized by localized heating from a heating structure 109. The ink firing chamber is bounded by walls created by an orifice plate 111, a layered silicon substrate 113, and firing chamber barrel walls 115, 117.

Figure 2:
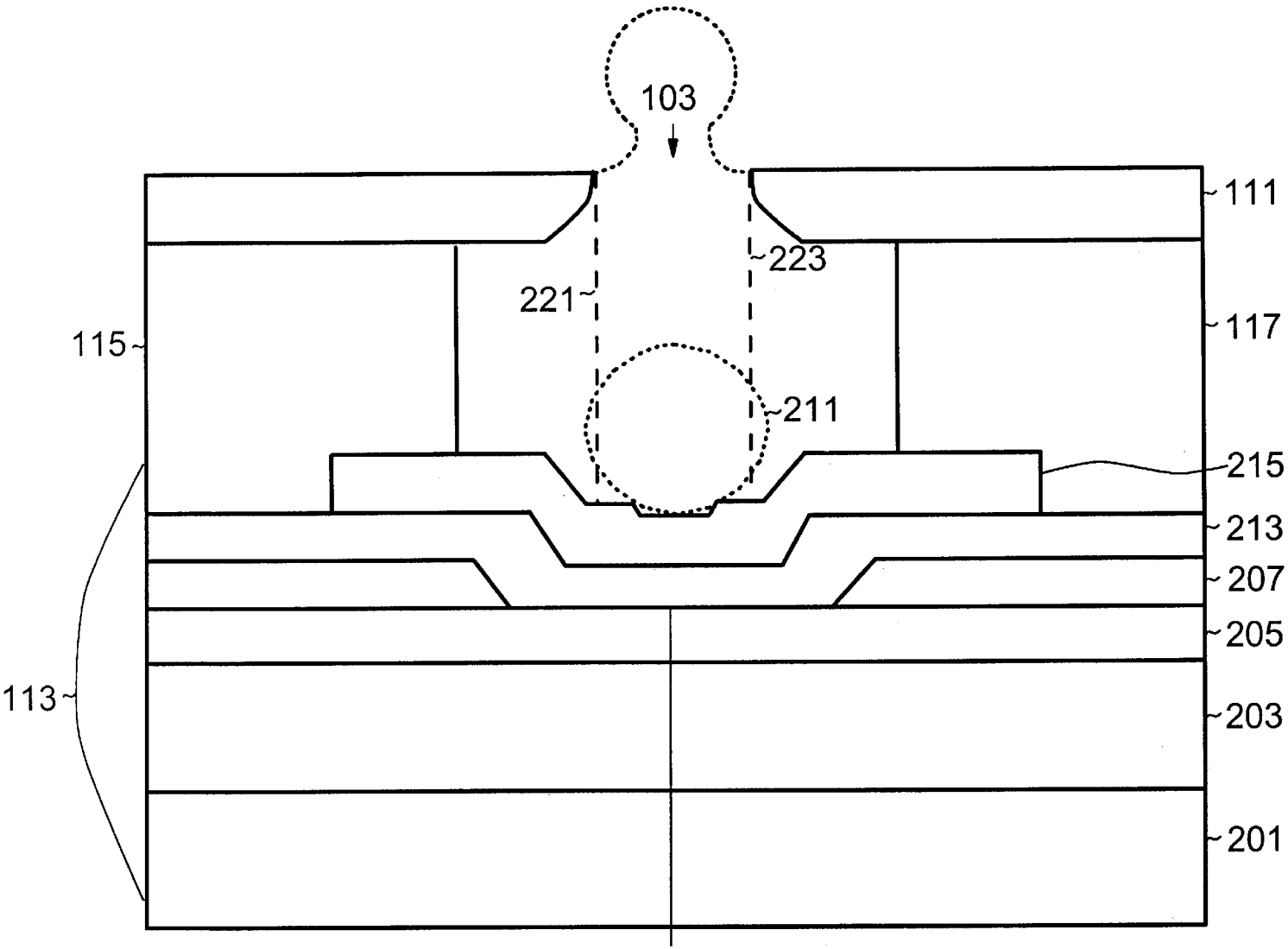
FIG. 2 is a cross section of the thermal inkjet printhead of FIG. 1 which may employ the present invention.

A cross section of the inkjet firing chamber taken through the heating structure 109 is shown in FIG. 2. The silicon substrate 113 has been expanded in this view to enhance the features of the preferred embodiment of its construction. It is assumed in this view that the firing chamber contains ink and that the ink liquid, ink vapor, and air interfaces are indicated by broken line. As a base, a p-type silicon volume 201 is covered with a thermal field oxide and chemical vapor deposited $SiO_2$ as the underlayer 203. A layer 205 of Tantalum Aluminum (TaAl) is conventionally deposited on the surface of the base and, because it is of a relatively high electrical resistance, forms a resistor layer. A conductor layer 207 of aluminum (Al) is selectively deposited on the TaAl layer 205 by means of photolithographically masking and developing, leaving open areas (such as area 209) of TaAl. Because of the relatively low electrical resistance of the Al layer 207, the high resistance of the TaAl layer 205 is effectively shorted by the Al layer 207 except in the open area 209. The result is a resistor area capable of transferring heat produced from the electrical resistance heating of the TaAl layer 205 in this open area 209 to vaporize liquid ink.

The areas above the resistor must be capable of withstanding thermal extremes, mechanical assault, and chemical attack which result from the rapid vaporization of the ink and subsequent collapse of the ink bubble (shown in broken line 211). Accordingly, a passivating layer 213, such as a typical $SiN_x$ compound, is deposited over the structure. Further, a cavitation barrier 215 consisting of tantalum Ta is deposited over and selectively etched from the passivation layer 213 in the ink firing chamber to protect against the fluid turbulence created by the collapsing bubble.

It is important to the understanding of the present invention that some characteristics of the fluid ink be described. Phase transitions from gas to liquid and from liquid to gas occur at known combinations of pressure, volume, and temperature for a given fluid. Under certain conditions of interest to inkjet printing, a phase transition from ink liquid to ink vapor may occur at temperatures elevated from the normal boiling point of the liquid to superheated temperatures. Rapid boiling occurs above the superheat temperature and will physically initiate more readily at locations of dissimilarities on the surface 215 known as heterogeneous nucleation sites. It has been shown that for two critical bubble nuclei, one within the ink and one on the surface of the heating structure 109, the energy necessary to form a bubble in the ink is much larger than to heterogeneously form a bubble on the heating structure surface. If an interface surface exists for heterogeneous nucleation, the number of atoms which must be vaporized to provide a segment of radius of curvature which is critical for growth, r*, is much lower and will therefore preferentially result in nucleation at that surface. See, P. G. shewmon, *Transformations in Metals*, McGraw Hill Book Co., 1969, PP. 157–163. Further, it is thermodynamically more efficient that heterogeneous nucleation occur rather than homogenous nucleation.

Because heterogenous nucleation is more efficient, its controlled use is desirable in an inkjet printer to conserve power and reduce the size of the resistor heaters. Heterogenous nucleation, however, is unpredictable on semi-smooth surfaces. This unpredictability in an inkjet printhead can result in a variation in the momentum vector imparted to ejected ink droplets, causing random variations in the position of deposition of the droplets on the medium and orifice edge dispersion of droplets into undesirable spray.

Figure 3:
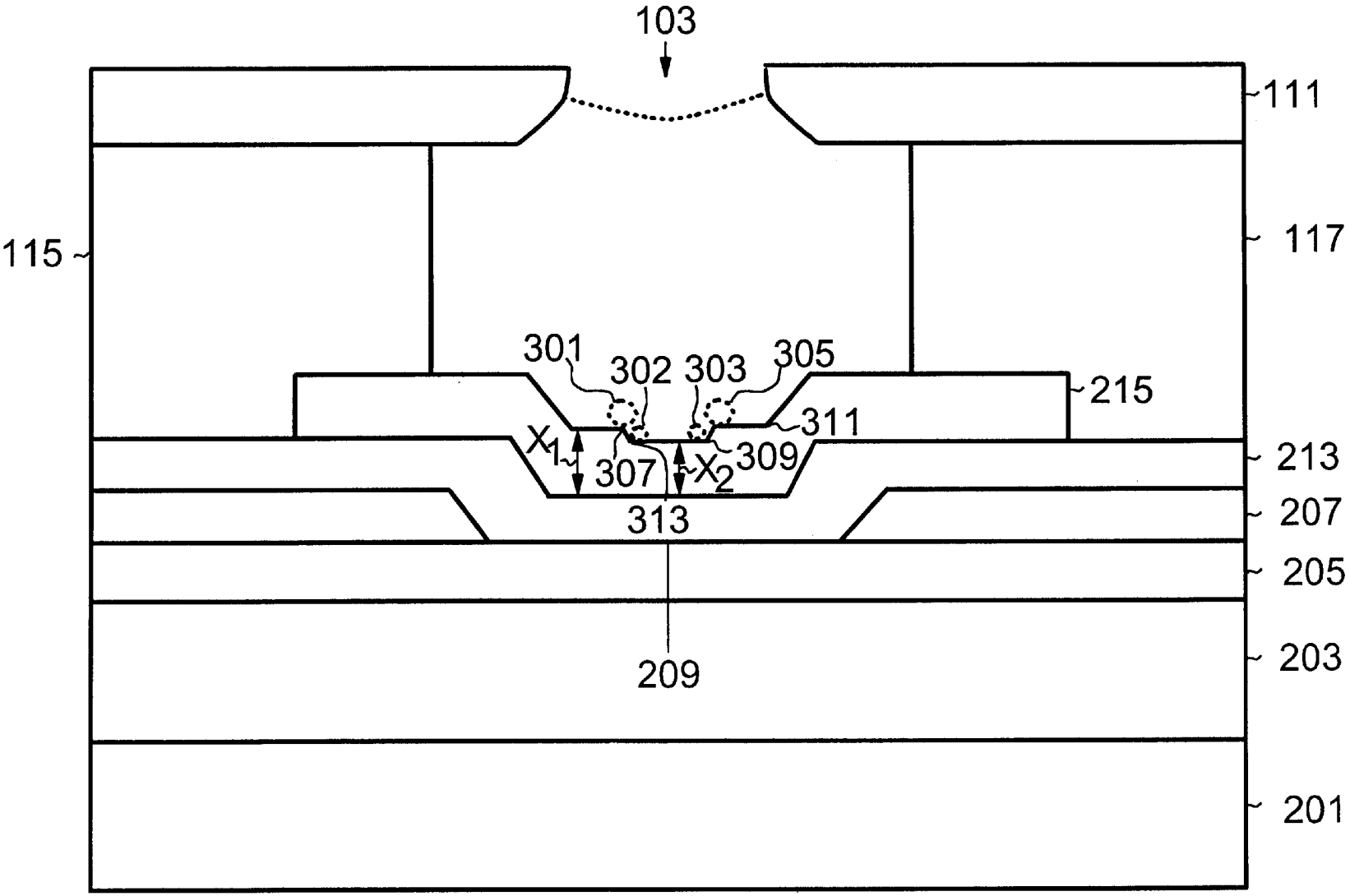
FIG. 3 is a cross section of the thermal inkjet printhead of FIG. 1 illustrating preferred nucleation sites and which may employ the present invention.

It is an important feature of the present invention, therefore, that the locations of nucleation are made non-random and optimized in position. This is accomplished by creating features in the ink heating surface having structural defects reducing the critical free energy of formation ($\Delta G^*$) of a vapor bubble in the ink fluid thereby allowing bubbles to nucleate in preferred locations with respect to the exiting orifice 103. Referring now to FIG. 3, several bubbles 301, 302, 303, 305 are shown as formed at planned step discontinuities 307, 309, 311, 313 in the surface of the cavitation barrier layer 215 which is in contact with the ink. In the preferred embodiment, the cavitation barrier layer 215 is initially deposited as a relatively uniform thickness $X_1$ (approximately 0.8 microns) of tantalum. A photolithographic process is employed to selectively etch and reduce the thickness of the tantalum over a central portion of the heating resistor to a thickness $X_2$ of approximately 0.6 microns. In addition to providing discontinuities, 303, 305, 307, and 309, the reduced thickness of the Ta barrier layer 215 provides a lower thermal resistance to the heat energy created by the resistor 205 in area 209 than the thicker area of the Ta barrier layer. Thus, two values of thermal insulation are presented to thermal energy propagation form the resistor 205. It should be observed that the passivation layer 213 also provides a thermal resistance to the flow of heat energy from the resistor and can be reduced or increased in thickness to effect a similar nucleation. This passivation layer 213 could also be used to produce a similar discontinuity in the barrier layer 215 by a similar, conventional, photolithographic process.

Figure 4:
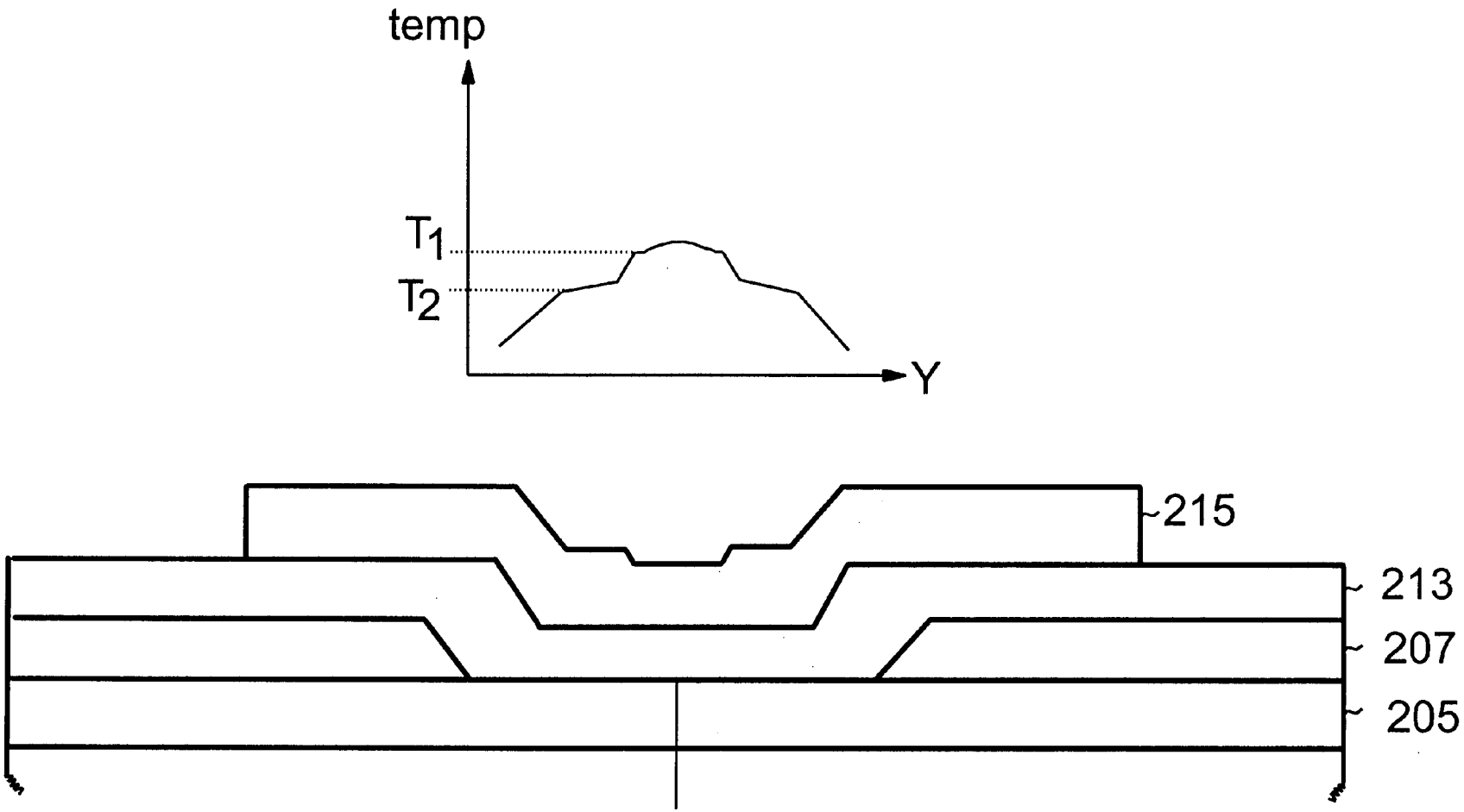
FIG. 4 is a cross section of the thermal inkjet printhead of FIG. 1 which may employ the present invention and which shows an approximate temperature profile of a heating element.

A thermal profile indicating an approximate temperature-position relationship across the area 209 is shown in FIG. 4. The highest temperatures are realized at the location where the resistor layer 205 develops the greatest temperature and where the thermal resistance of the covering layers is the least. Generally, the resistor layer 205 has a uniform resistance and the underlayer 203 reflects a uniform amount of heat energy. The resistor is independently addressed via the conductive layer 207 as the specific orifii of the inkjet printhead are determined to be required to deposit ink droplets on the medium. A pulse of electricity having a duration of approximately 3 microseconds and 0.4 ampere is applied. Conductor layer 207, however, conducts some heat energy away from the edges of the resistance area 209, leaving the center of the area with a higher temperature than the edges. The temperature difference is substantially enhanced at the surface of the Ta cavitation barrier layer 215 by the reduced thickness so that the greatest temperature is realized at the central portion of barrier layer 215 and near the discontinuities 303, 305, 307, and 309. Thus during the time the resistor is conducting the electric pulse, a temperature Ti of approximately 500° C. can be reached across the area of minimum thickness and a temperature T2 of approximately 300° C. can be reached at the thicker areas of the Ta cavitation barrier layer 215. It can be appreciated that the thermal conditions for nucleation can be controlled across the heating area 209 and nucleation sites can be established at particular locations in the heating area 209.

Referring again to FIG. 2, an imaginary projection of the orifice opening perimeter can be drawn perpendicularly to the surface of the cavitation barrier layer 215 (as shown in broken lines 221 and 223). It is a feature of the present invention that the step discontinuities and the thinned cavitation barrier layer 215 fall within the projected footprint of the orifice. While only one structure of relatively simple geometry is shown, more than one structure within the projected footprint may be employed in the practice of the present invention. This geometry provides a bubble growth and a resulting maximum ink droplet momentum vector closer to the direction of the central axis of the orifice. The droplets which are expelled from the orifice, then, have a more uniform placement on the printed medium and a higher quality print is achieved. Due to the structure of the heating area, miscellaneous nucleation at other sites is less likely to occur than those heterogeneous nucleation events which occur at discontinuities 307, 309, 311, and 313 (which are positioned beneath the orifice exit 103). In the preferred embodiment, the shape of the heating structure is essentially circular, however, other configurations may be employed without departing from the scope of the present invention. The minimum size of the thinned area and step discontinuities is related to the slope of the walls of the discontinuities and can be altered to create results desired by the designer.

Figure 5:
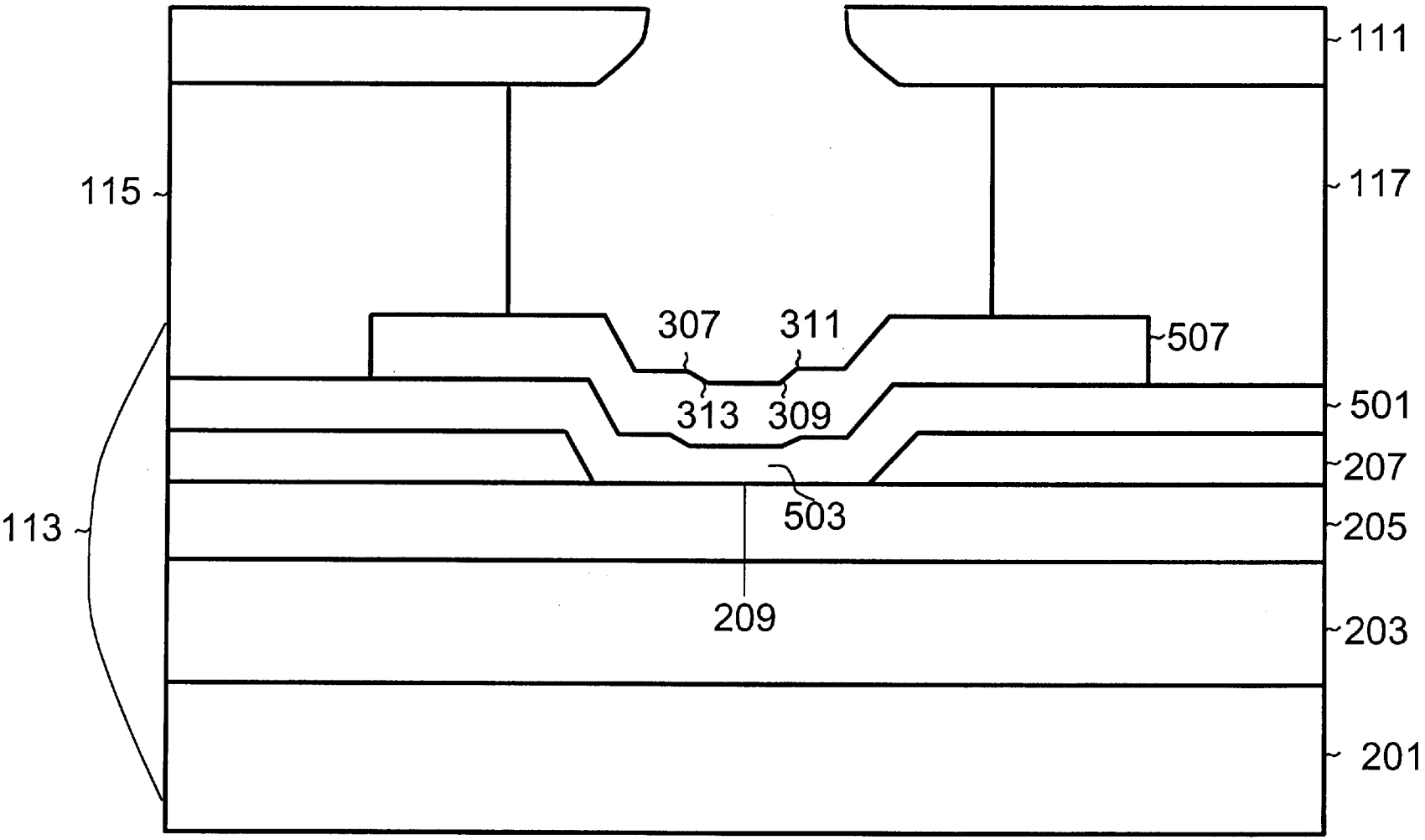
FIG. 5 is a cross section of an alternative embodiment of a thermal inkjet printhead and which may employ the present invention.

An alternative embodiment of the present invention is shown in the cross sectional view of FIG. 5. The ink firing chamber is constructed using the orifice plate 111, the firing chamber barrel elements 115 and 117, and a silicon substrate 113 as walls of the chamber, as previously described. In the alternative embodiment, the $SiN_x$ passivation layer 501 is deposited as above but additional photolithographic masking and etching steps yield a thinner layer of passivation in an area 503 in the resistor area 209. The dual thickness passivation layer 501 is then covered by a tantalum cavitation barrier layer 507 which maintains the surface topography of the passivation layer to produce the discontinuities 307, 309, 311, and 313.

I claim:

1. A thermal inkjet printhead arranged such that a consistently located gas phase ink bubble is formed comprising:

an ink firing chamber for containing ink;

an electrically activated essentially planar heating element disposed in thermal communication with said ink firing chamber;

a thermally insulating layer disposed continuously between said heating element and said ink firing chamber, said thermally insulating layer further comprising at least one preferred heterogeneous nucleation site as a discontinuity in said thermally insulating layer which reduces the critical free energy of formation for the gas phase ink bubble and selectively disposed on a surface of said thermally insulating layer which is in contact with ink when ink is in said ink firing chamber, whereby a consistently located gas phase ink bubble may be formed; and an orifice plate forming at least one boundary of said ink firing chamber and including at least one orifice from which ink from said ink firing chamber is expelled normal to the plane of said heating element when said heating element is electrically activated.

2. A thermal inkjet printhead in accordance with claim 1 wherein said at least one preferred heterogeneous nucleation site is selectively disposed in predetermined alignment with one of said at least one orifice.

3. A thermal inkjet printhead in accordance with claim 2 wherein said predeterminedly aligned at least one preferred heterogeneous nucleation site is selectively disposed within a footprint of one of said at least one orifice essentially perpendicularly projected on said thermally insulating layer.

4. A thermal inkjet printhead in accordance with claim 1 wherein said thermal insulating layer further comprises an area of first insulation value disposed within a footprint of one of said at least one orifice essentially perpendicularly projected on said thermally insulating layer and an area of second insulation value disposed at least partially surrounding said area of first insulation value, said second insulation value having a value greater than said first insulation value.

5. A thermal inkjet printhead in accordance with claim 4 further comprising an essentially stepped interface between said area of second insulation value and said area of first insulation value whereby a zone of high activation energy as a preferred nucleation site is created.

6. A thermal inkjet printhead in accordance with claim 1 further comprising an electric conductor, disposed such that said electric conductor is spaced apart from the ink when ink is in said ink firing chamber by said thermally insulating layer, which conveys an electric signal to said electrically activated heating element.

7. A thermal inkjet printhead in accordance with claim 6 wherein said electric conductor further comprises a predetermined first and second thickness joined by a step, which step is disposed within a footprint of one of said at least one orifice essentially perpendicularly projected on said thermally insulating layer.

8. A thermal inkjet printhead in accordance with claim 1 wherein said discontinuity further comprises a thickness step.

9. A thermal inkjet printhead for a printing apparatus, the thermal inkjet printhead arranged such that a consistently located gas phase ink bubble is formed, comprising:

an ink firing chamber for containing ink;

an orifice plate forming one boundary of said ink firing chamber and having at least one orifice from which ink from said ink firing chamber is expelled;

a layered substrate forming a second boundary of said ink firing chamber opposite said orifice plate, said layered substrate comprising:

a high electrical resistance resistor layer, a low electrical resistance conductor layer disposed on substantially all of said resistor layer except for at least one predetermined heating site which is disposed within an essentially perpendicularly projected footprint of one orifice on said low electrical resistance conductor layer, a passivation layer disposed on substantially all of said conductor layer and having a first thermal resistance, and a barrier layer disposed on said passivation layer at least continuously over said at least one predetermined heating site, having a second thermal resistance, and having at least one preferred heterogeneous nucleation site selectively disposed within an essentially perpendicularly projected footprint of one orifice on a surface of said barrier layer which is in contact with the ink when the ink is in said ink firing chamber, whereby the ink bubble is consistently formed within said footprint.

10. A thermal inkjet printhead in accordance with claim 9 wherein said barrier layer further comprises an area of first thickness disposed within said footprint of one orifice on said surface of said barrier layer and an area of second thickness disposed at least partially surrounding said area of first thickness, said second thickness having a value greater than said first thickness.

11. A thermal inkjet printhead in accordance with claim 10 further comprising an essentially stepped interface between said area of second thickness and said area of first thickness whereby a zone of high activation energy as a preferred nucleation site is created.

12. A thermal inkjet printhead in accordance with claim 9 wherein said resistor layer further comprises a predetermined first and second thickness joined by a step, which step is disposed within said perpendicularly projected footprint of one orifice on said surface of said barrier layer.

13. A method of manufacture of a thermal inkjet printhead which includes an ink firing chamber defined by at least one wall for containing ink and which forms a gas phase ink bubble at a consistent location, comprising the steps of:

creating an electrically activated essentially planar heating element in thermal communication with the ink firing chamber;

disposing at least one thermally insulating layer continuously between said heating element and the ink firing chamber;

creating at least one preferred heterogeneous nucleation site comprising a discontinuity in said thermally insulating layer which reduces the critical free energy of formation for the gas phase ink bubble at a selected location on a surface of said thermally insulating layer which is in contact with ink when ink is in the ink firing chamber, thereby forming a consistently located gas phase ink bubble; and producing, in one wall of the ink firing chamber, at least one orifice from which ink from said ink firing chamber is expelled normal to the plane of said heating element when said heating element is electrically activated.

14. A method in accordance with the method of claim 13 wherein said step of creating at least one preferred heterogeneous nucleation site further comprises the steps of:

forming an area of first insulation value in said thermal insulating layer within a footprint defined by an essentially perpendicular projection of one of said at least one orifice on said thermally insulating layer; and forming an area of second insulation value, said second insulation value having a value greater than said first insulation value.

15. A method in accordance with the method of claim 14 further comprising the step of creating an essentially stepped interface between said area of second insulation value and said area of first insulation value thereby producing at least one zone of high activation energy as a preferred nucleation site.

16. A method in accordance with the method of claim 15 wherein said step of depositing a resistor layer further comprises the step of creating an essentially predetermined first and second thickness joined by a step, which step is disposed within said perpendicularly projected footprint of one orifice on said surface of said barrier layer.

17. A method in accordance with the method of claim 13 further comprising the steps of:

connecting an electrical conductor to said electrically activated heating element; and producing a first and second thickness joined by a step feature in said electric conductor, which step feature is disposed within a footprint defined by an essentially perpendicular projection of one of said at least one orifice on said thermally insulating layer.

18. A method in accordance with the method of claim 13 wherein said step of creating at least one preferred heterogeneous nucleation site further comprises the step of creating a rapid thickness change in said thermally insulating layer.

19. A method of manufacture of a thermal inkjet printhead which includes an ink firing chamber for containing ink and which forms a gas phase ink bubble at a consistent location, comprising the steps of:

forming an orifice plate as one wall of the ink firing chamber;

creating at least one orifice in said orifice plate from which ink from said ink firing chamber is expelled;

forming, opposite said orifice plate, a layered substrate as a second wall of said ink firing chamber, forming said layered substrate comprising the steps of:

depositing a high electrical resistance resistor layer on a substrate base, depositing a low electrical resistance conductor layer on substantially all of said resistor layer except for at least one predetermined heating site, said predetermined heating site disposed within an essentially perpendicularly projected footprint of one orifice on said low electrical resistance conductor layer, depositing a passivation layer on substantially all of said conductor layer, and depositing a barrier layer with at least one preferred heterogeneous nucleation site at a selected location on said passivation layer at least over said at least one predetermined heating site, said barrier layer having said at least one preferred heterogeneous nucleation site disposed within an essentially perpendicularly projected footprint of one orifice on a surface of said barrier layer which is in contact with the ink when the ink is in said ink firing chamber, whereby the ink bubble is consistently formed within said footprint.

20. A method accordance with the method of claim 19 wherein said step of depositing a barrier layer with at least one preferred heterogeneous nucleation site further comprises the steps of:

creating an area of first thickness within said footprint of one orifice on a surface of said barrier layer; and creating an area of second thickness at least partially surrounding said area of first thickness, said second thickness having a value greater than said first thickness.

21. A method in accordance with the method of claim 20 further comprising the step of creating an essentially stepped interface between said area of second thickness and said area of first thickness whereby a zone of reduced free energy activation, $\Delta G^*$, as a preferred nucleation site is created.

22. A thermal inkjet printhead arranged such that a consistently located gas phase ink bubble is formed, comprising:

an ink firing chamber for containing ink;

an electrically activated heating element disposed in thermal communication with said ink firing chamber;

an orifice plate forming at least one boundary of said ink firing chamber and including at least one orifice from which ink from said ink firing chamber is expelled when said heating element is electrically activated; and a thermally insulating layer disposed continuously between said heating element and said ink firing chamber, said thermally insulating layer further comprising at least one step in said thermally insulating layer thickness disposed within a footprint of one of said at least one orifice essentially perpendicularly projected on said thermally insulating layer, whereby the ink bubble is consistently formed within said footprint.

* * * * *